United States Patent [19]

Levy

[11] 4,360,755

[45] Nov. 23, 1982

[54] ANODE MOUNTING FOR WINDOW TYPE GEIGER-MUELLER TUBE

[75] Inventor: Stephen Levy, Ocean City, N.J.

[73] Assignee: The United States of America as represented by the Secretary of the Army, Washington, D.C.

[21] Appl. No.: 221,953

[22] Filed: Dec. 31, 1980

[51] Int. Cl.[3] ..... H01J 47/00
[52] U.S. Cl. ..... 313/93
[58] Field of Search ..... 313/93

[56] References Cited

U.S. PATENT DOCUMENTS

| | | | |
|---|---|---|---|
| 2,714,680 | 8/1955 | Warmoltz et al. | 313/93 |
| 2,776,390 | 1/1957 | Anton | 313/93 |
| 4,180,754 | 12/1979 | Levy | 313/93 |

*Primary Examiner*—Robert Segal
*Attorney, Agent, or Firm*—Nathan Edelberg; Jeremiah G. Murray; Michael C. Sachs

[57] ABSTRACT

To prevent the anode wire which runs along the axis of the tube from vibrating at the end adjacent the window, a ceramic cup has a flat surface sealed to the inside of the window, and the end of the anode wire is captured within an opening of the cup.

1 Claim, 5 Drawing Figures

ANODE MOUNTING FOR WINDOW TYPE GEIGER-MUELLER TUBE

The invention described herein may be manufactured and used by or for the Government for governmental purposes without the payment of any royalties thereon or therefor.

BACKGROUND OF THE INVENTION

This invention relates to the art of nuclear radiation detectors, and more particularly to an improvement in the mounting of the axial anode wire at the mica window end of low range Geiger-Mueller tubes.

Low range Geiger-Mueller tubes such as the BS-1, Phillips 18538 or JAN 5979 have an outside cathode cylindrical shell enclosing an anode wire running along the cylindrical axis. At one end of the tube there is a ceramic end cap which seals the cathode to the anode and provides for the outside anode contact. At the opposite end the anode wire is unsupported. At this end of the tube a mica window is sealed to the outside shell providing a vacuum tight seal. The tube volume contains a mixture of rare gases and a halogen. The combination of gases and applied tube voltages allows small discharges to occur inside the tube volume when exposed to nuclear radiation or X radiation. End window tubes of this type are disclosed in U.S. Pat. Nos. 2,714,680 (original end-window tube) and 2,776,390 (design of JAN 5979).

The problem with the above JAN 5979 tube design is that in a moving vehicle the anode wire (at the unsupported end) can vibrate eventually shorting to the cathode shell giving spurious readings. The solution has been to support this end of the anode wire to prevent these oscillations. Various anode supports have been used. One design stands out as better than the others.

That design (1) uses a small ceramic cup (or hat) which is glass-frit sealed onto an appropriately sized hole located at the center portion of the mica window. The hat is oriented so that anode wire is captured within the open end of the cup. (FIGS. 1A–1C).

Alternate designs include (2) an anode support using twisted wire electrically separated by ceramic rods and (3) an anode support using a ceramic rod sealed inside the cathode with a hole through which the anode wire fits and onto which it is sealed.

The limitations of designs (2) and (3) are that the ceramic-metal interface between anode and cathode presents a source of high electrical field stress. They are difficult to manufacture and in the case of (3), it segments the anode into two regions separated by the dielectric (ceramic) rod. The structure of (1) which avoids contact with the cathode and does not require a frit seal to the anode wire, however, still has the following disadvantages: (a) there is a problem of how to locate and accurately drill the thin mica window for the ceramic cup; (b) the edges of the mica hole through covered by frit and sealed to the cup can present an area of stress when vacuum is pulled on the tube and is a potential source of air leaks; (c) the bottom of the cup protrudes through the window and prevents a cover from laying flat over the front of the tube; (d) there are expensive aligning and sealing techniques; and (e) the shoulder of the cup needed to align and seal it, blocks more of the window area.

SUMMARY OF THE INVENTION

The object of the invention is to provide an improved means to anchor the anode wire at the window end.

According to the invention, a small ceramic cup (or hat) is sealed onto the front mica window, on the inside, without drilling a hole therein.

The advantages are that (1) there is not hole in the mica window, (2) easier jigging for the cap, (3) the reduced shoulder reduces window blockage for incoming radiation, (4) simplified construction, and (5) the outside face of the window is flat.

DETAILED DESCRIPTION

Figure 1A:
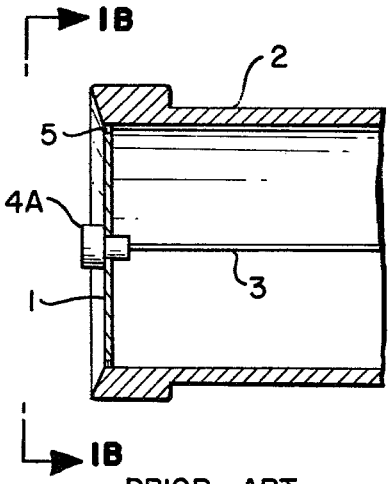
PRIOR ART FIG.1A
FIGS. 1A–1C show three forms of prior art arrangements for supporting the anode wire at the window end of a Geiger-Mueller tubes.
Figure 1B:
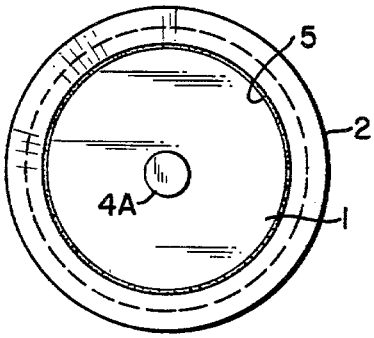
PRIOR ART FIG.1B
Figure 1C:
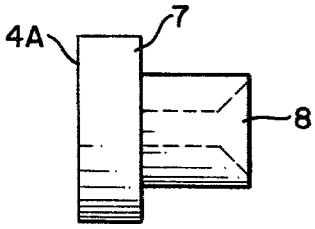
PRIOR ART FIG.1C

The prior art of most interest is shown in FIGS. 1A–1C. The basic construction is similar to that show in U.S. Pat. Nos. 2,714,680 and 2,776,390. FIG. 1A is a longitudinal section view of the window end of a Geiger-Mueller tube, FIG. 1B is an end view of FIG. 1A, looking toward the window and FIG. 1C is an enlarged side view of the cup for the anode wire.

Figure 2:
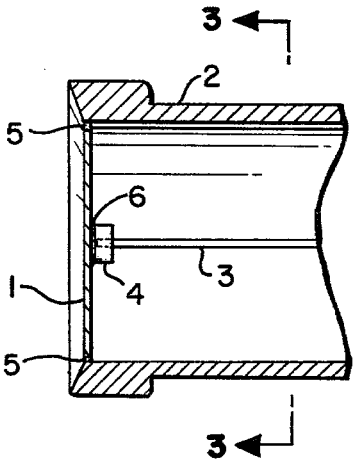
FIG. 2 is a longitudinal section view of an anode wire support arrangement according to the invention.
Figure 3:
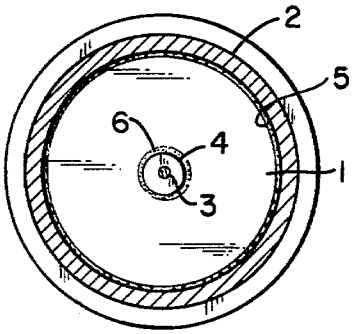
FIG. 3 is a cross section view along lines 3—3 of FIG. 2.

A tube with the anode mounting according to the invention is shown in FIGS. 2 and 3. FIG. 2 is a longitudinal section view of the window end, and FIG. 3 is a cross-section view taken along lines 3—3 of FIG. 2. The construction of the prior art tube in FIGS. 1A and 1B, and that of FIGS. 2 and 3, is basically the same, and therefore the same reference characters are used for components which are alike. The tube consists of an outer cathode stainless steel cylinder 2, and an inner stainless steel anode wire running and centered along the cylindrical major axis. One end of the cathode is mechanically sealed to the anode wire using an electrical insulator between anode and cathode (not shown, see U.S. Pat. Nos. 2,714,680 and 2,776,390, or my U.S. Pat. No. 4,180,754 for a Geiger-Mueller Tube With Re-Entrant Insulator at Opposing Sealed Ends Thereof). The other end of the cathode cylinder is closed off by a thin mica window 1 (3.5 milligrams per square centimeter). The window is sealed to the cathode cylinder using glass frit 5.

The anode wire extends toward the center of the mica window 1 but terminates inside a ceramic cup 4 or 4A, typically fabricated from a ceramic such as that sold under the trademark FOSTERITE. The ceramic cup 4 or 4A is deep enough to prevent the anode wire from leaving the confines of the cup when the tube is subjected to shock and vibration. The ceramic cup could be shaped in a number of configurations: (a) wide cup to maximize contact area on mica windows and to reduce window strain, (b) narrow cup to reduce window strain, (c) tapered cup opening to gradually decrease electrode field gradients, and facilitate wire anode alignment. For the mounting according to the invention, the base of the cup 4 is flat and it is sealed to the inside mica window surface with glass frit 6.

This contrasts with the mounting shown in FIGS. 1A and 1B in which a hole is drilled into the mica window 1, and the cup 4A is mounted with the shoulder bearing on the outside of the window. The disadvantages of this and other prior art arrangements are discussed in the "Background" section.

What is claimed is:

1. A Geiger-Mueller tube with which a geiger discharge is produced comprising:

a tubular cylindrical metal cathode, an elongated metal anode coaxially disposed within said cathode along the longitudinal axis of said cathode, a gaseous medium disposed in the space between said cathode and said anode, one end of the cathod being mechanically sealed to the anode using an electrical insulating means between the anode and the cathode, a radiation-permeable window sealed across the other end of said cathode, the anode being terminated a short distance from the window without any seal, the improvement including a ceramic cup which has a flat surface at one end and a cup-like hole formed with an opening at the other end, with said glass frit flat surface sealed onto the center portion of the mica window which remains intact, and the anode being captured within said cup-like hole.

* * * * *

UNITED STATES PATENT AND TRADEMARK OFFICE

CERTIFICATE OF CORRECTION

PATENT NO. : 4,360,755

DATED : November 23, 1982

INVENTOR(S) : Stephen Levy

It is certified that error appears in the above-identified patent and that said Letters Patent is hereby corrected as shown below:

On the title page:

In the address shown for the inventor, Mr. Stephen Levy, "Ocean City, N.J." is corrected to read --Ocean, N.J.--.

Column 4, line 1, claim 1, "cathod" is corrected to read -- cathode --.

Signed and Sealed this

*Fifth* Day of *April 1983*

[SEAL]

*Attest:*

GERALD J. MOSSINGHOFF

*Attesting Officer*

*Commissioner of Patents and Trademarks*